US010783844B2

(12) United States Patent
Yabuki

(10) Patent No.: US 10,783,844 B2
(45) Date of Patent: Sep. 22, 2020

(54) DISPLAY DEVICE AND METHOD FOR CONTROLLING DISPLAY DEVICE

(71) Applicant: SAKAI DISPLAY PRODUCTS CORPORATION, Sakai-shi, Osaka (JP)

(72) Inventor: Haruhito Yabuki, Sakai (JP)

(73) Assignee: SAKAI DISPLAY PRODUCTS CORPORATION, Sakai-shi, Osaka (JP)

( * ) Notice: Subject to any disclaimer, the term of this patent is extended or adjusted under 35 U.S.C. 154(b) by 39 days.

(21) Appl. No.: 16/096,407

(22) PCT Filed: Apr. 27, 2016

(86) PCT No.: PCT/JP2016/063235
§ 371 (c)(1),
(2) Date: Jan. 23, 2019

(87) PCT Pub. No.: WO2017/187565
PCT Pub. Date: Nov. 2, 2017

(65) Prior Publication Data
US 2019/0156772 A1 May 23, 2019

(51) Int. Cl.
*G09G 3/36* (2006.01)
*G09G 3/20* (2006.01)

(52) U.S. Cl.
CPC ..... *G09G 3/3611* (2013.01); *G09G 3/20* (2013.01); *G09G 3/2007* (2013.01); *G09G 3/36* (2013.01); *G09G 2320/0276* (2013.01)

(58) Field of Classification Search
CPC .. G09G 3/3611; G09G 3/3607; G09G 3/2007; G09G 3/36; G09G 3/20
See application file for complete search history.

(56) References Cited

U.S. PATENT DOCUMENTS

2005/0140829 A1* 6/2005 Uchida ..... H04N 5/142 348/625
2009/0022402 A1* 1/2009 Lee ..... G06T 3/4007 382/195

(Continued)

FOREIGN PATENT DOCUMENTS

JP H9-090910 A 4/1997
JP 2003255908 A 9/2003
WO 2013/002146 A1 1/2013

*Primary Examiner* — Abbas I Abdulselam
(74) *Attorney, Agent, or Firm* — ScienBiziP, P.C.

(57) ABSTRACT

This display device comprises a display panel whereon a plurality of pixels are disposed, and a drive unit for driving the display panel. The display device includes: a conversion unit that convers an original signal representing the luminance of the pixel into a brightened signal and/or a darkened signal; a calculation unit that calculates the difference in luminance of the original signal between one pixel unit and another pixel unit located next to the one pixel unit; a determination unit that determines whether or not the difference in luminance exceeds a threshold; a selection unit that selects the original signal when determined that the difference in luminance exceeds the threshold, and selects the brightened signal or the darkened signal when determined that the difference in luminance does not exceed the threshold; and an input unit that inputs an input signal based on the signal selected by the selection unit into the drive unit.

8 Claims, 8 Drawing Sheets

(56) References Cited

U.S. PATENT DOCUMENTS

| | | | | |
|---|---|---|---|---|
| 2011/0254884 | A1* | 10/2011 | Cho | G09G 3/3648 345/691 |
| 2014/0118423 | A1 | 5/2014 | Hasegawa et al. | |
| 2016/0133199 | A1* | 5/2016 | Chu | G09G 3/3413 345/690 |

* cited by examiner

R G B R G B R G B

| R | G | B | R | G | B | R | G | B |
|---|---|---|---|---|---|---|---|---|
| X[−1, −1] | Y[−1, −1] | Z[−1, −1] | X[0, −1] | Y[0, −1] | Z[0, −1] | X[1, −1] | Y[1, −1] | Z[1, −1] |
| X[−1, 0] | Y[−1, 0] | Z[−1, 0] | X[0, 0] | Y[0, 0] | Z[0, 0] | X[1, 0] | Y[1, 0] | Z[1, 0] |
| X[−1, 1] | Y[−1, 1] | Z[−1, 1] | X[0, 1] | Y[0, 1] | Z[0, 1] | X[1, 1] | Y[1, 1] | Z[1, 1] |

FIG. 7

| | | | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|---|
| R | G | B | R | G | B | R | G | B | R | G | B | R | G | B | R | G | B | R | G | B | R | G | B | R | G | B | R | G | B | R | G | B | R |
| A | B | A | B | A | B | A | B | A | B | A | B | A | B | A | B | A | B | A | B | A | B | A | B | A | B | A | B | A | B | A | B | A | B |
| B | A | B | A | B | A | B | A | B | A | B | A | B | A | B | A | B | A | B | A | B | A | B | A | B | A | B | A | B | A | B | A | B | A |
| A | B | A | B | A | B | A | B | A | C | C | C | C | C | C | C | C | C | C | C | C | C | C | C | A | B | A | B | A | B | A | B | A | B |
| B | A | B | A | B | A | C | C | C | C | C | C | C | C | C | C | C | C | C | C | C | C | C | C | C | C | C | A | B | A | B | A | B | A |
| A | B | A | B | A | B | C | C | C | C | C | C | C | C | C | C | C | C | C | C | C | C | C | C | C | C | C | B | A | B | A | B | A | B |
| B | A | B | A | B | A | C | C | C | C | C | C | C | C | C | C | C | C | C | C | C | C | C | C | C | C | C | A | B | A | B | A | B | A |
| A | B | A | B | A | B | C | C | C | C | C | C | C | C | C | C | C | C | C | C | C | C | C | C | C | C | C | B | A | B | A | B | A | B |
| B | A | B | A | B | A | C | C | C | C | C | C | C | C | C | C | C | C | C | C | C | C | C | C | C | C | C | A | B | A | B | A | B | A |
| A | B | A | B | A | B | C | C | C | C | C | C | C | C | C | C | C | C | C | C | C | C | C | C | C | C | C | B | A | B | A | B | A | B |
| B | A | B | A | B | A | C | C | C | C | C | C | C | C | C | C | C | C | C | C | C | C | C | C | C | C | C | A | B | A | B | A | B | A |
| A | B | A | B | A | B | A | B | A | C | C | C | C | C | C | C | C | C | C | C | C | C | C | C | A | B | A | B | A | B | A | B | A | B |
| B | A | B | A | B | A | B | A | B | A | B | A | B | A | B | A | B | A | B | A | B | A | B | A | B | A | B | A | B | A | B | A | B | A |
| A | B | A | B | A | B | A | B | A | B | A | B | A | B | A | B | A | B | A | B | A | B | A | B | A | B | A | B | A | B | A | B | A | B |

Variation 1

| | | | | | | | | | | | |
|---|---|---|---|---|---|---|---|---|---|---|---|
| R | G | B | R | G | B | R | G | B | R | G | B |
| A | A | B | B | A | A | B | B | A | A | B | B |
| B | B | A | A | B | B | A | A | B | B | A | A |
| A | A | B | B | A | A | B | B | A | A | B | B |
| B | B | A | A | B | B | A | A | B | B | A | A |

Variation 2

| | | | | | | | | | | | |
|---|---|---|---|---|---|---|---|---|---|---|---|
| R | G | B | R | G | B | R | G | B | R | G | B |
| A | B | A | B | A | B | A | B | A | B | A | B |
| A | B | A | B | A | B | A | B | A | B | A | B |
| B | A | B | A | B | A | B | A | B | A | B | A |
| B | A | B | A | B | A | B | A | B | A | B | A |

Variation 3

| | | | | | | | | | | | |
|---|---|---|---|---|---|---|---|---|---|---|---|
| R | G | B | R | G | B | R | G | B | R | G | B |
| A | A | A | B | B | B | A | A | A | B | B | B |
| B | B | B | A | A | A | B | B | B | A | A | A |
| A | A | A | B | B | B | A | A | A | B | B | B |
| B | B | B | A | A | A | B | B | B | A | A | A |

Variation 4

| | | | | | | | | | | | |
|---|---|---|---|---|---|---|---|---|---|---|---|
| R | G | B | R | G | B | R | G | B | R | G | B |
| A | B | B | A | A | B | B | A | A | B | B | A |
| B | A | A | B | B | A | A | B | B | A | A | B |
| A | B | B | A | A | B | B | A | A | B | B | A |
| B | A | A | B | B | A | A | B | B | A | A | B |

Variation 5

| | | | | | | | | | | | |
|---|---|---|---|---|---|---|---|---|---|---|---|
| R | G | B | R | G | B | R | G | B | R | G | B |
| A | B | A | B | A | B | A | B | A | B | A | B |
| B | A | B | A | B | A | B | A | B | A | B | A |
| B | A | B | A | B | A | B | A | B | A | B | A |
| A | B | A | B | A | B | A | B | A | B | A | B |

FIG. 9

DISPLAY DEVICE AND METHOD FOR CONTROLLING DISPLAY DEVICE

TECHNICAL FIELD

The present technique relates to a display apparatus that displays video.

BACKGROUND ART

In order to improve field of view angle characteristics, a typical liquid crystal display apparatus is proposed that converts an original signal indicating a luminance (grayscale value) into a signal indicating a luminance higher than the luminance indicated by the original signal (signal indicating "brightness") or a signal indicating a luminance lower than the luminance indicated by the original signal (signal indicating "darkness").

In intermediate grayscale display by the liquid crystal display apparatus, an effective luminance (average luminance) of a pixel to which a signal indicating "brightness" is input (bright pixel) and a pixel to which a signal indicating "darkness" is input (dark pixel) is presented as a target luminance.

For example, a liquid crystal display apparatus disclosed in Patent Literature 1 is provided with two voltage correction circuits having different input/output characteristics, and inverted or non-inverted outputs of the voltage correction circuits are selected for each of predetermined pixels. Characteristics of the two voltage correction circuits are composited visually, with a result that degradation of grayscale display including for example blocked up shadows or reversal can be reduced and visual characteristics can be improved.

CITATION LIST

Patent Literature

[Patent Literature 1] Japanese Patent Application Laid-Open Publication No. HEI 09-090910

SUMMARY OF INVENTION

Technical Problem

When the target luminance is presented according to the effective luminance of a bight pixel and a dark pixel through conversion of the original signal to the signal indicating brightness or darkness in a region where a luminance difference between adjacent pixels (luminance difference between target luminances) is small, display quality hardly reduces. However, when the target luminance is presented by the effective luminance of the bright pixel and the dark pixel through conversion of the original signal to the signal indicating brightness or darkness in a region where the luminance difference between adjacent pixels is large, reduction in display quality including for example jagged appearance may be caused.

The present embodiment has been made in view of the foregoing, and has its object of providing a display apparatus in which reduction in display quality can be suppressed in a situation in which the target luminance is presented according to the effective luminance of the bight pixel and the dark pixel through conversion of the original signal to the signal indicating brightness or darkness.

Solution to Problem

A display apparatus according to the present embodiment includes a display panel in which a plurality of pixels are arranged in a matrix and a drive section that drives the display panel based on an input signal. The display apparatus further includes a conversion section, a calculation section, a determination section, a selection section, and an input section. The conversion section converts, for each of the pixels, an original signal indicating a luminance into either or both a bright signal and a dark signal. The bright signal indicates a luminance brighter than the luminance indicated by the original signal. The dark signal indicates a luminance darker than the luminance indicated by the original signal. The calculation section calculates a luminance difference between an original signal for one pixel unit and an original signal for another pixel unit. The one pixel unit includes at least one pixel among the pixels. The other pixel unit is located adjacent to the one pixel unit and includes at least one pixel other than the at least one pixel included in the one pixel unit among the pixels. The determination section determines whether or not the luminance difference calculated by the calculation section exceeds a threshold value. The selection section selects the original signal for the one pixel unit when the determination section determines that the luminance difference exceeds the threshold value, and selects the bright signal or the dark signal for the one pixel unit when the determination section determines that the luminance difference does not exceed the threshold value. The input section inputs to the drive section the input signal based on a signal selected by the selection section.

A display apparatus controlling method according to the present embodiment is a method for controlling a display apparatus that includes a display panel in which a plurality of pixels are arranged in a matrix and a drive section that drives the display panel based on an input signal. The display apparatus controlling method includes: converting, for each of the pixels, an original signal indicating a luminance into either or both a bright signal and a dark signal, the bright signal indicating a luminance brighter than the luminance indicated by the original signal, the dark signal indicating a luminance darker than the luminance indicated by the original signal; calculating a luminance difference between an original signal for one pixel unit and an original signal for another pixel unit, the one pixel unit including at least one pixel among the pixels, the other pixel unit being located adjacent to the one pixel unit and including at least one pixel other than the at least one pixel included in the one pixel unit among the pixels; determining whether or not the calculated luminance difference exceeds a threshold value; selecting the original signal for the one pixel unit when it is determined that the luminance difference exceeds the threshold value, or selecting the bright signal or the dark signal for the one pixel unit when it is determined that the luminance difference does not exceed the threshold value; and inputting to the drive section the input signal based on a selected signal.

Advantageous Effects of Invention

According to the present embodiment, reduction in display quality can be suppressed in a situation in which the target luminance is presented by the effective luminance of the bight pixel and the dark pixel through conversion of the original signal to a signal indicating brightness or darkness.

BRIEF DESCRIPTION OF DRAWINGS

FIG. 7 is an explanatory drawing explaining coordinates of a target picture element and picture elements located therearound in an input display pattern.

FIG. 8 is a conceptual diagram schematically illustrating a display pattern on which results of selection by a grayscale selection section is reflected.

FIG. 9 is a conceptual diagram illustrating variations of an allotment pattern.

DESCRIPTION OF EMBODIMENTS

Figure 1:
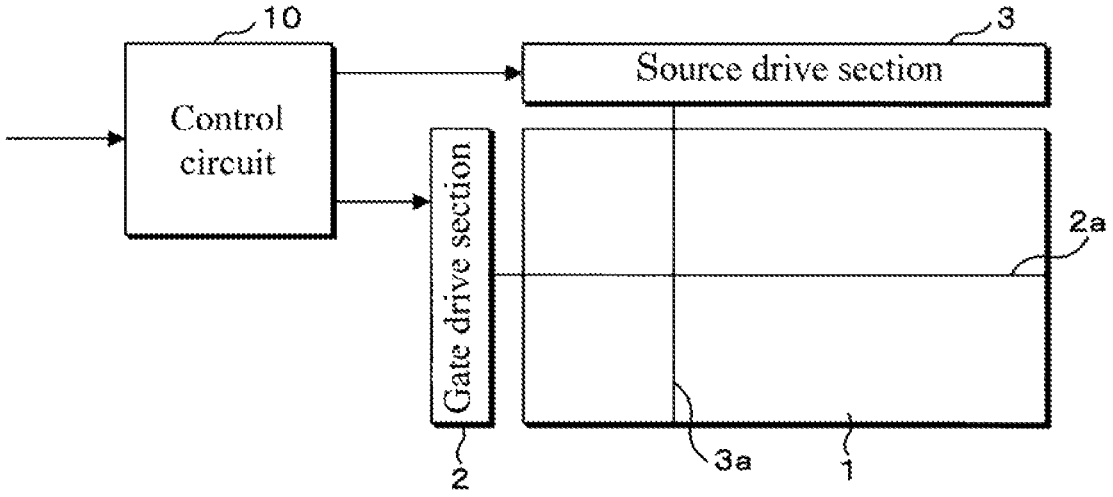
FIG. 1 is a block diagram schematically illustrating a display apparatus according to an embodiment.

A display apparatus according to an embodiment will be described below with reference to the accompanying drawings. FIG. 1 is a block diagram schematically illustrating the display apparatus. The display apparatus includes a display panel 1 in a rectangular shape including liquid crystal. A plurality of gate signal lines 2*a* extending in one direction and a plurality of source signal lines 3*a* extending in another direction perpendicular to the one direction are formed in the display panel 1. Note that one gate signal line 2*a* and one source signal line 3*a* are illustrated as representatives and the other gate signal lines 2*a* and the other source signal lines 3*a* are not illustrated.

Pixels are provided in respective segments defined in a matrix by the gate signal lines 2*a* and the source signal lines 3*a*. Each of the pixels includes for example a switching element (e.g., a thin film transistor) connected to a gate signal line 2*a* and a source signal line 3*a* and a capacitor connected to the switching element.

The gate signal lines 2*a* transmit gate signals input from a gate drive section 2. The source signal lines 3*a* transmits data signals input from a source drive section 3 and each indicating a grayscale value. The gate signals and the data signals are transmitted to the respective switching elements. The switching element is driven based on the gate signal and the data signal to change alignment of the liquid crystal according to a target luminance in each pixel. In the following description, a grayscale value that is a digital value is used as a luminance. However, the grayscale value is an example of the luminance and an analog value may be used instead.

The display apparatus includes a control circuit 10 including for example a logic circuit, read only memory (ROM), and random access memory (RAM). The logic circuit is operated according to a look up table (LUT) 55 (see FIG. 3) and a setting stored in the Rom to control driving of the display apparatus. Examples of the logic circuit includes a field programmable gate array (FPGA) and an application specific integrated circuit (ASICA). The control circuit 10 for example processes input video data, synchronization signals, and display position coordinates, and outputs, to the gate drive section 2 and the source drive section 3, a control signal for controlling the gate drive section 2, a control signal for controlling the source drive section 3, the video data, the synchronization signals, the display position coordinates and the like.

Figure 2:
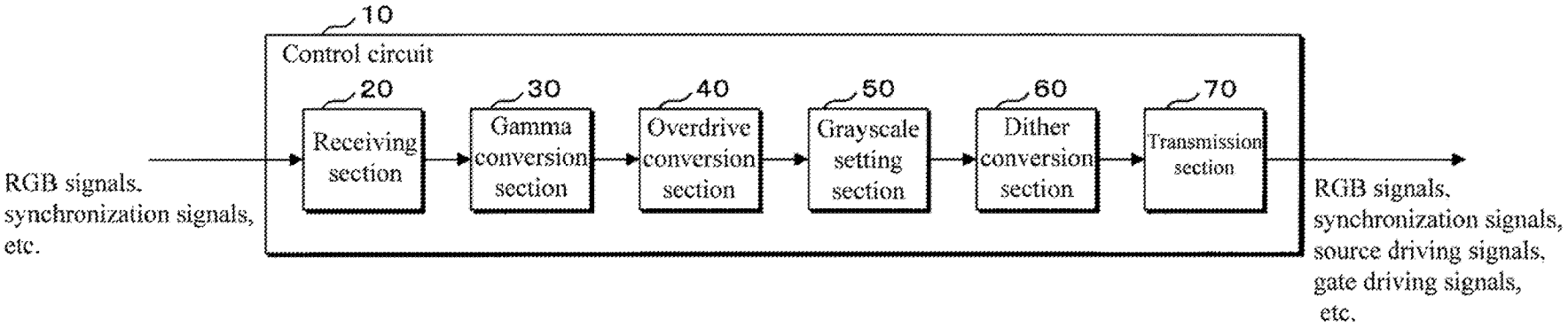
FIG. 2 is a functional block diagram schematically illustrating a control circuit.

FIG. 2 is a functional block diagram schematically illustrating the control circuit 10. The control circuit 10 includes a receiving section 20, a gamma conversion section 30, an overdrive conversion section 40, a grayscale setting section 50, a dither conversion section 60, and a transmission section 70 (input section).

The receiving section 20 receives for example red (R), green (G), and blue (B) video data (R signals, G signals, and B signals) and synchronization signals. The gamma conversion section 30 executes gamma conversion on the received R signals, G signals, and B signals according to characteristics of the display panel 1. The overdrive conversion section 40 executes overdrive conversion on the gamma-converted R signals, G signals, and B signals to increases response speed of mainly R signals, G signals, and B signals having intermediate grayscale values.

The grayscale setting section 50 sets grayscale values for the overdrive-converted R signals, G signals, and B signals (original signals). That is, the grayscale setting section 50 selects any one of an original signal, a bright signal indicating a grayscale value for brightness, and a dark signal indicating a grayscale value for darkness for each of the pixels. The grayscale setting section 50 will be described later in detail. The dither conversion section 60 executes dithering conversion on the R signals, the G signals, and the B signals for which the grayscale values are set, that is, signals that each are any one of the original signals, the bright signals, and the dark signals and that each have been selected by the grayscale setting section 50. The transmission section 70 transmits, to the source drive section 3 and the gate drive section 2, signals such as the synchronization signals and the dithering-converted R signals, B signals, and G signals, that is, signals (input signals) that each are any one of the original signals, the bright signals, and the dark signals and that each have been selected by the grayscale setting section 50 and subjected to dithering conversion.

Figure 3:
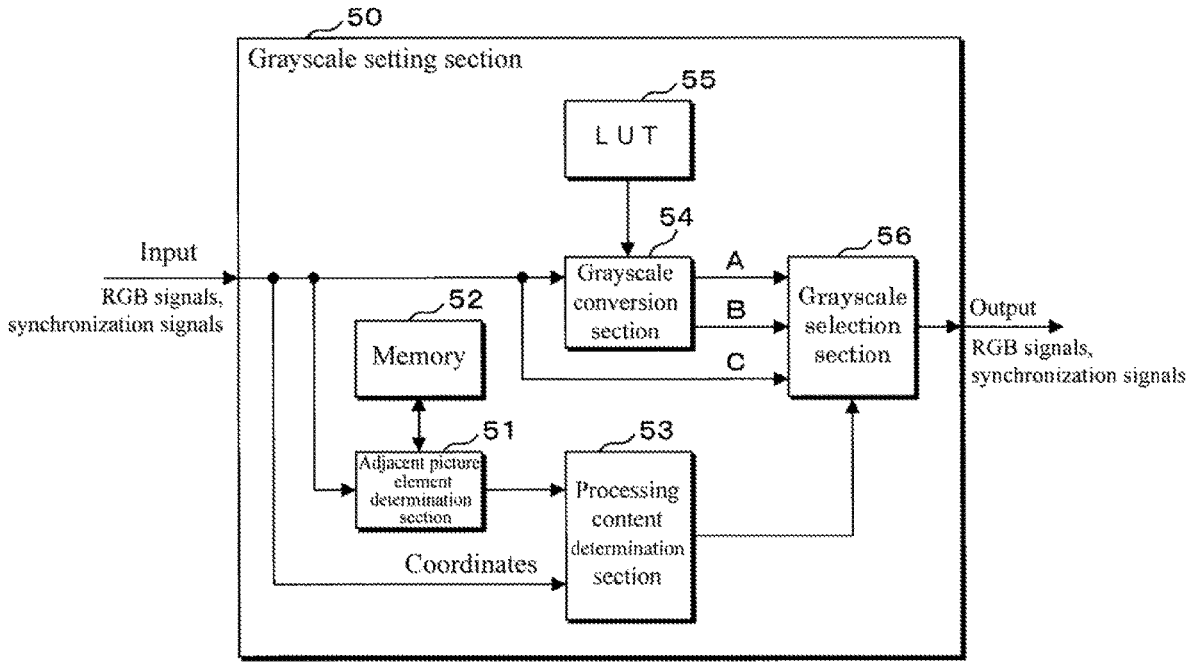
FIG. 3 is a functional block diagram schematically illustrating a grayscale setting section.
Figure 4:
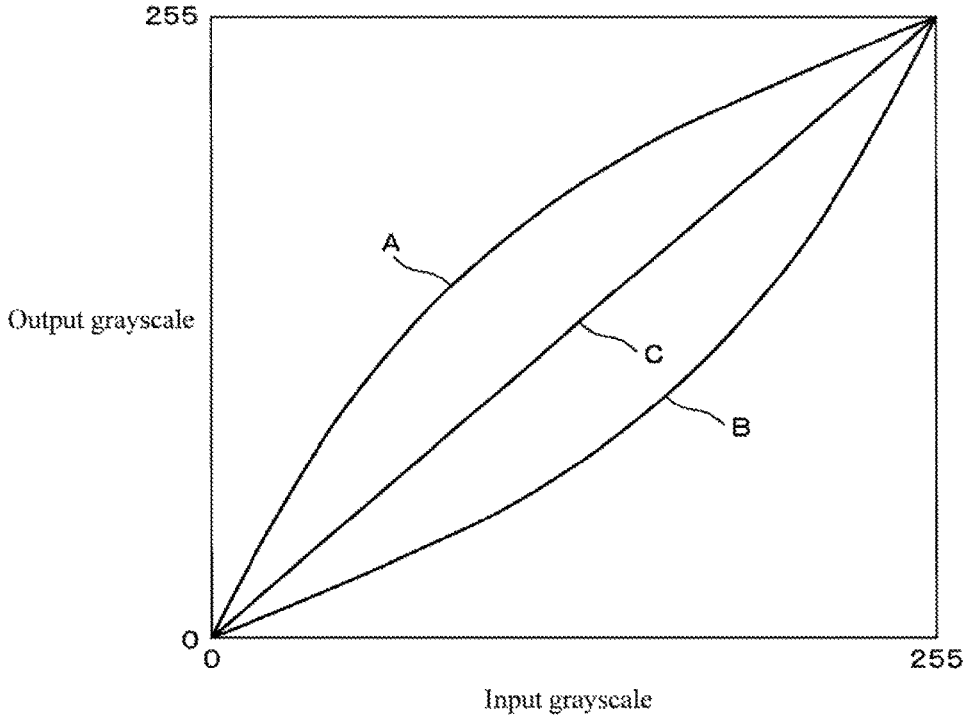
FIG. 4 is a graph representation showing relationships (tables) between input grayscale values and output grayscale values stored in a LUT.
Figure 5:
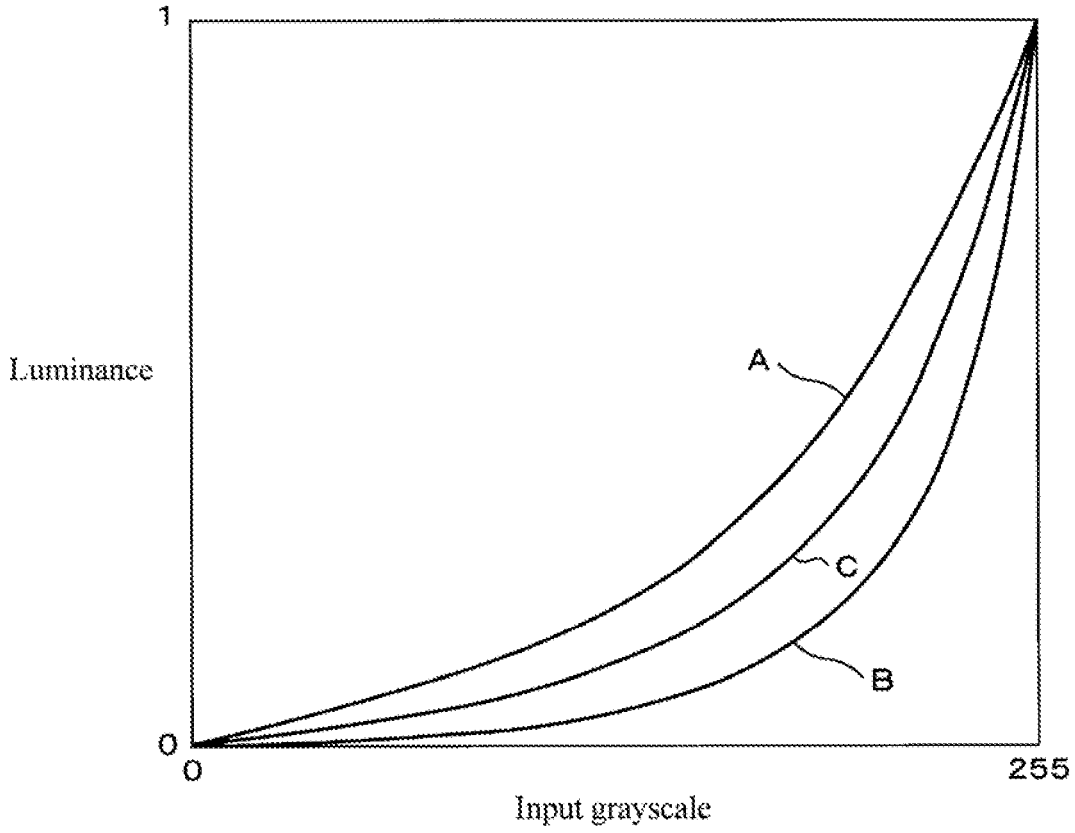
FIG. 5 is a graph representation showing gamma curves indicating luminance relative to the input grayscale values.

FIG. 3 is a functional block diagram schematically illustrating the grayscale setting section 50. FIG. 4 is a graph representation showing relationships (tables) between input grayscale values and output grayscale values stored in the LUT 55. FIG. 5 is a graph representation showing gamma curves indicating luminance relative to input grayscale values.

The grayscale setting section 50 includes an adjacent picture element determination section 51, memory 52, a processing content determination section 53, a grayscale conversion section 54, the LUT 55, and a grayscale selection section 56. The LUT 55 stores therein tables C, A. and B (see FIGS. 4 and 5). The table C corresponds to a gamma curve C representing a "target" for image display on the display panel 1. The table A corresponds to a gamma curve A representing "brightness" that is brighter than the target. The Table B corresponds to a gamma curve B representing "darkness" that is darker than the target (see FIGS. 4 and 5).

Figure 6:
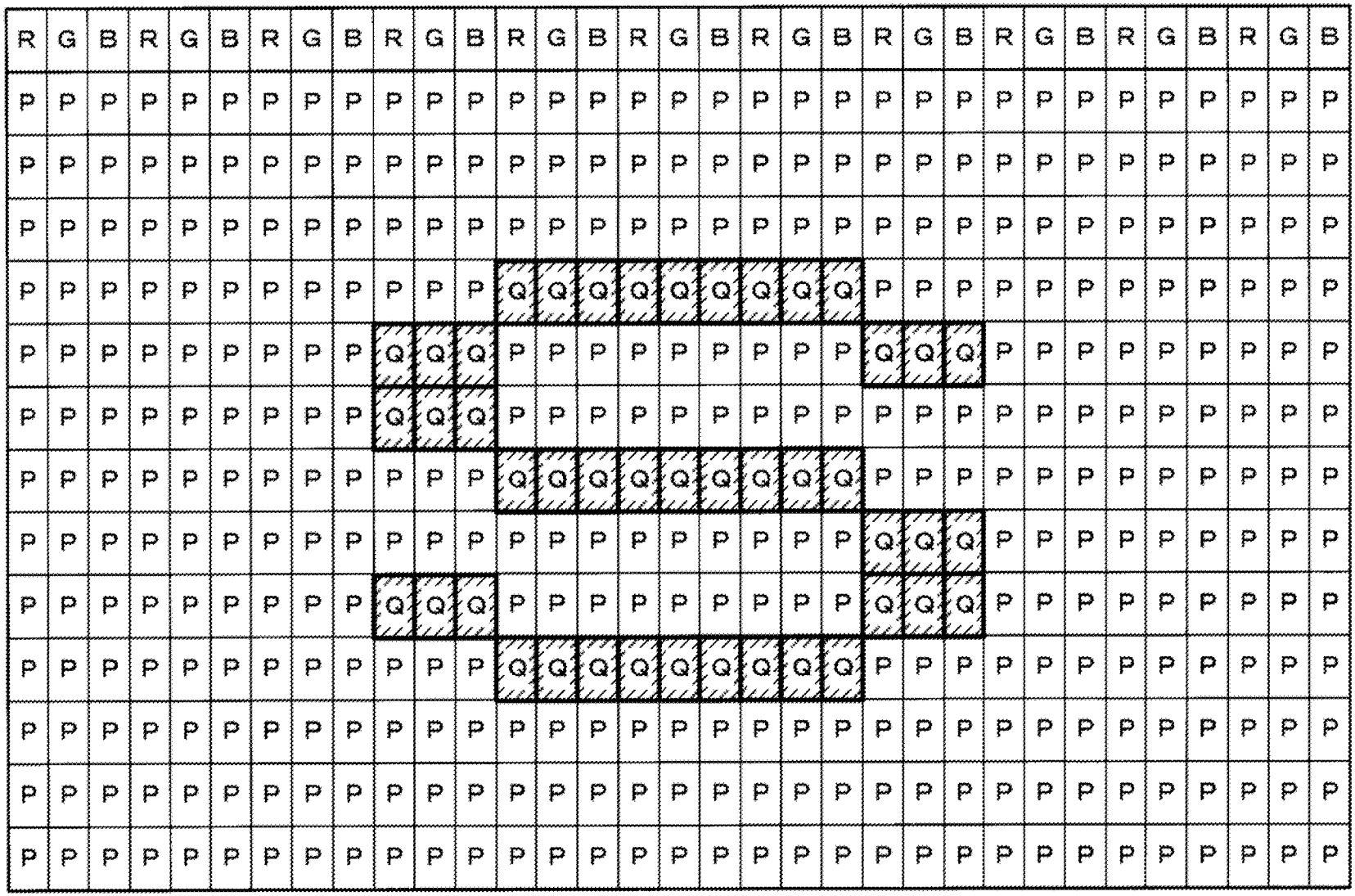
FIG. 6 is a conceptual diagram illustrating an example of R signals, G signals, and B signals (a display pattern) input to the grayscale setting section.

FIG. 6 is a conceptual diagram illustrating an example of R signals, G signals, and B signals (a display pattern) input to the grayscale setting section 50. "R", "G", and "B" indicated in the uppermost row in FIG. 6 represent a red pixel column, a green pixel column, and a blue pixel column, respectively. "RGB" pixels adjacent right and left, that is, three pixels of an "R" pixel, a "G" pixel, and a "B" pixel adjacent right and left to one another constitute a picture element. The picture element is equivalent to an example of a pixel unit. Note that the R signals, G signals, and B signals input to the grayscale setting section 50 correspond to the original signals. Also, an R signal, a G signal, and a B signal are signals indicating grayscale values of the respective pixels (an R pixel, a G pixel, and a B pixel).

In the example illustrated in FIG. 6, grayscale values of some of plural pixels forming the display pattern each are a grayscale value P while grayscale values of the other pixels each are a grayscale value Q. As illustrated in FIG. 6, the display pattern presents "S" (see a hatched portion in FIG. 6) composed of the pixels having the grayscale value Q with a background pattern composed of the pixels having the grayscale value P. Note that a relationship between an input grayscale value and an output grayscale value in each pixel composing the display pattern in the initial state corresponds to the table C.

Respective rows forming the display pattern (more specifically, signal strings indicating grayscale values of the respective pixels in the respective rows) are sequentially input to the grayscale setting section 50. Data indicating each grayscale value of the pixels in the rows is input to the adjacent picture element determination section 51 and stored in the memory 52. The grayscale conversion section 54 converts the grayscale value of each pixel composing an input display pattern into two grayscale values of "bright" and "dark" in a manner to apply the tables A and B to the pixels while referencing the LUT 55. The grayscale conversion section 54 inputs to the grayscale selection section 56 the converted bright and dark grayscale values (more exactly, a bright signal and a dark signal) in association with coordinates of each pixel. Note that original grayscale values before conversion by the grayscale conversion section 54 (more exactly, original signals indicating original grayscale values) are also input to the grayscale selection section 56. That is, three grayscale values of the bright grayscale value, the dark grayscale value, and the original grayscale value are input to the grayscale selection section 56 for each of the pixels.

A pattern representing a relationship between the coordinates of each pixel and the tables A and B to be applied to the pixel, that is, an allotment pattern indicating which of the table A (bright signal) or the table B (dark signal) is to be applied to the pixel is set in advance in the grayscale setting section 50. An example of the allotment pattern is a staggered pattern in which the tables A and B are alternately applied to the pixels (see FIG. 8 which will be referred to later).

The following describes processing by the adjacent picture element determination section 51. FIG. 7 is an explanatory drawing explaining respective coordinates of a target picture element and picture elements located therearound in the input display pattern. In FIG. 7, [a, b] represents coordinates wherein "a" represents a position on an abscissa while "b" represents a position on an ordinate in a unit of a picture element. Also, X [a, b] represents a grayscale value of an R pixel at the coordinates [a, b], Y [a, b] represents a grayscale value of a G pixel at the coordinates [a, b], and Z[a, b] represents a grayscale value of a B pixel at the coordinates [a, b]. In the adjacent picture element determination section 51, coordinates (also referred to below as target coordinates) of a picture element that is a determination target (also referred to below as a target picture element) are represented by [0, 0].

When a display pattern is input to the grayscale setting section 50, the adjacent picture element determination section 51 calculates differences (luminance differences) between respective grayscale values (luminances) of a R pixel, a G pixel, and a B pixel at the target coordinates [0, 0], that is X [0, 0], Y [0, 0], and Z [0, 0] and respective grayscale values of an R pixel, a G pixel, and a B pixel of each of 8 adjacent picture elements around the picture element at the target coordinates [0, 0]. The adjacent picture element determination section 51 then determines whether or not all the calculated differences (absolute values) do not exceed a threshold value. Difference calculation and determination described above are performed for example on a type-by-type basis of pixels (R pixel, G pixel, and B pixel in the present embodiment). Individual threshold values may be set for the R pixel, the G pixel, and the B pixel. Alternatively, the same threshold value may be set for all of the R pixels, the G pixels, and the B pixels.

That is, when it is assumed that J represents a threshold value for the R pixels, K represents a threshold value for the G pixels, and L represents a threshold value for the B pixels, the adjacent picture element determination section 51 determines whether or not the grayscale value of each R pixel satisfies $|X[-1,-1]-X[0,0]|\leq J$, $|X[0,-1]-X[0,0]|\leq J$, $|X[1,-1]-X[0,0]|\leq J$, $|X[-1,0]-X[0,0]|\leq J$, $|X[1,0]-X[0,0]|\leq J$, $|X[-1,1]-X[0,0]|\leq J$, $|X[0,1]-X[0,0]|\leq J$, and $|X[1,1]-X[0,0]|\leq J$.

The adjacent picture element determination section 51 also determines whether or not the grayscale value of each G pixel satisfies $|Y[-1,-1]-Y[0,0]|\leq K$, $|Y[0,-1]-Y[0,0]|\leq K$, $|Y[1,-1]-Y[0,0]|\leq K$, $|Y[-1,0]-Y[0,0]|\leq K$, $|Y[1,0]-Y[0,0]|\leq K$, $|Y[-1,1]-Y[0,0]|\leq K$, $|Y[0,1]-Y[0,0]|\leq K$, and $|Y[1,1]-Y[0,0]|\leq K$.

The adjacent picture element determination section 51 further determines whether or not the grayscale value of each B pixel satisfies $|Z[-1,-1]-Z[0,0]|\leq L$, $|Z[0,-1]-Z[0,0]|\leq L$, $|Z[1,-1]-Z[0,0]|\leq L$, $|Z[-1,0]-Z[0,0]|\leq L$, $|Z[1,0]-Z[0,0]|\leq L$, $|Z[-1,1]-Z[0,0]|\leq L$, $|Z[0,1]-Z[0,0]|\leq L$, and $|Z[1,1]-Z[0,0]|\leq L$.

When all the above relationships are satisfied for the grayscale values of the R pixel, the G pixel, and the B pixel at the target coordinates [0, 0], the adjacent picture element determination section 51 determines to convert the grayscale values of the picture element located at the target coordinates [0, 0], that is, the target picture element. When any of the above relationship is not satisfied therefor, the adjacent picture element determination section 51 determines not to convert the grayscale values of the target picture element.

That is, the adjacent picture element determination section 51 determines not to convert the grayscale values of the target picture element when it is determined for any of the R pixel, the G pixel, and the B pixel of the target picture element that a luminance difference between the pixel of the target picture element and a corresponding pixel of at least one of the 8 picture elements adjacent to the target picture element exceeds a corresponding one of the threshold values J, K, and L.

Note that the adjacent picture element determination section 51 may calculate differences between the grayscale values of the target picture element and grayscale values of picture elements vertically adjacent to the target picture element rather than the above-described determination method.

That is, the adjacent picture element determination section 51 may determine whether or not $|X[0,-1]-X[0,0]\leq J$, $|X[0,1]-X[0,0]|\leq J$, $|Y[0,-1]-Y[0,0]|\leq K$, $|Y[0,1]-Y[0,0]|\leq K$, $|Z[0,-1]-Z[0,0]|\leq L$, and $|Z[0,1]-Z[0,0]|\leq L$ are satisfied. In the above configuration, the adjacent picture element determination section 51 determines to convert the grayscale values of the target picture element when all of the above relationships are satisfied, and determines not to convert the grayscale values of the target picture element when at least one of the above relationships are not satisfied.

Alternatively, the adjacent picture element determination section 51 may calculate differences between the grayscale values of the target picture element and grayscale values of picture elements horizontally adjacent to the target picture element rather than the above-described determination method.

That is, the adjacent picture element determination section 51 may determine whether or not $|X[-1, 0]-X[0, 0]| \leq J$, $|X[1, 0]-X[0, 0]| \leq J$, $|Y[-1, 0]-Y[0, 0]| \leq K$, $|Y[1, 0]-Y[0, 0]| \leq K$, $|Z[-1, 0]-Z[0, 0]| \leq L$, and $|Z[1, 0]-Z[0, 0]| \leq L$ are satisfied. In the above configuration, the adjacent picture element determination section 51 determines to convert the grayscale values of the target picture element when all of the above relationships are satisfied, and determines not to convert the grayscale values of the target picture element when at least one of the above relationships is not satisfied.

Furthermore, the adjacent picture element determination section 51 may calculate differences between the grayscale values of the target picture element and grayscale values of picture elements diagonally adjacent to the target picture element rather than the above-described determination method.

That is, the adjacent picture element determination section 51 may determine whether or not $|X[-1, -1]-X[0, 0]| \leq J$, $|X[1, -1]-X[0, 0]| \leq J$, $|X[-1, 1]-X[0, 0]| \leq J$, $|X[1, 1]-X[0, 0]| \leq J$, $|Y[-1, -1]-Y[0, 0]| \leq K$, $|Y[1, -1]-Y[0, 0]| \leq K$, $|Y[-1, 1]-Y[0, 0]| \leq K$, $|Y[1, 1]-Y[0, 0]| \leq K$, $|Z[-1, -1]-Z[0, 0]| \leq L$, $|Z[1, -1]-Z[0, 0]| \leq L$, $|Z[-1, 1]-Z[0, 0]| \leq L$, and $|Z[1, 1]-Z[0, 0]| \leq L$ are satisfied. In the above configuration, the adjacent picture element determination section 51 determines to convert the grayscale values of the target picture element when all of the above relationships are satisfied, and determines not to convert the grayscale values of the target picture element when at least one of the above relationships is not satisfied.

The adjacent picture element determination section 51 accesses the memory 52 in execution of the above-described determination to reference respective rows forming the display pattern (more specifically, data indicating grayscale values of the pixels forming the rows) stored in the memory 52. Note that a flip-flop circuit may be used rather than the memory 52 for calculation of differences between the grayscale values of the target picture element and the grayscale values of the picture elements horizontally adjacent to the target picture element. Also note that the adjacent picture element determination section 51 is equivalent to an calculation section and a determination section.

The adjacent picture element determination section 51 outputs a result of determination to the processing content determination section 53. The coordinates of the target picture element are input in advance in the processing content determination section 53. The processing content determination section 53 determines which of the tables A, B, and C is to be applied to the grayscale values of the target picture element based on the result of determination by the adjacent picture element determination section 51, the coordinates of the target picture element, and the allotted pattern. The processing content determination section 53 then outputs a result of determination to the grayscale selection section 56.

More specifically, the processing content determination section 53 determines to apply the table C to all of the pixels constituting the target picture element (i.e., the R pixel, the G pixel, and the B pixel at the target coordinates [0, 0]) when the adjacent picture element determination section 51 determines not to convert the grayscale values of the target picture element. In other words, it is determined that the table C is to be applied to the target picture element as a whole.

By contrast, when the adjacent picture element determination section 51 determines to convert the grayscale values of the target picture element, the processing content determination section 53 determines to apply the table A or B to each pixel constituting the target picture element (i.e., the R pixel, the G pixel, and the B pixel at the target, coordinates [0, 0]) while referencing the allotment pattern.

As described above, 3 grayscale values of the bright grayscale value, the dark grayscale value, and the original grayscale value for each pixel are input in the grayscale selection section 56. The grayscale selection section 56 selects one of the bright grayscale value, the dark grayscale value, and the original grayscale value for each pixel based on a result of determination by the processing content determination section 53, and outputs a signal indicating the selected grayscale value (bright signal, dark signal, or original signal).

More specifically, the grayscale selection section 56 selects a bright grayscale value for a pixel to which the table A is determined to be applied in the processing content determination section 53, and outputs the bright signal to the dither conversion section 60. The grayscale selection section 56 selects the dark grayscale value for a pixel to which the table B is determined to be applied in the processing content determination section 53, and outputs the dark signal to the dither conversion section 60. The grayscale selection section 56 selects the original grayscale value for a pixel to which the table C is determined to be applied in the processing content determination section 53, and outputs the original signal to the dither conversion section 60. Note that a combination of the processing content determination section 53 and the grayscale selection section 56 is equivalent to a selection section.

FIG. 8 is a conceptual diagram schematically illustrating a display pattern on which results of selection by the grayscale selection section 56 are reflected. It is assumed herein that a luminance difference between a grayscale value P and a grayscale value Q exceeds each of the threshold values J, K, and L (see FIG. 6). In FIG. 8, pixels of picture elements each as a whole to which the table C is determined to be applied are represented by "C". Pixels of picture elements each as a whole to which the table A or B is determined to be applied are represented by "A" or "B", respectively. A hatched portion corresponds to a characteristic pattern of "S" illustrated in FIG. 6.

Locations of "A" and "B" are set based on the allotment pattern. In the present embodiment, the allotment pattern is used in which the tables A and B are arranged in a staggered manner.

As illustrated in FIG. 8, Table C is applied to pixels located in the characteristic pattern of "S" and pixels therearound. Therefore, the characteristic pattern of "S" is clearly displayed without being blurred. In other words, the target luminances are presented by effective luminances of bright pixels and dark pixels through conversion of the original signals into the bright signals or the dark signals in a region where a luminance difference between adjacent pixels (luminance difference between target luminances) is small, that is, a region where the grayscale value P is set in succession. By contrast, luminances based on the original signals rather than the effective luminances of the bright pixels and the dark pixels are presented in a region where a luminance difference between adjacent pixels is large, that is, a region where the grayscale value P and the grayscale value Q are adjacent to each other (region of the characteristic pattern of "S" and therearound). Through the above, the characteristic pattern of "S" is clearly displayed without being blurred while field of view angle characteristics are improved. Note that in a case where the table A or B is applied to the pixels located in the characteristic pattern of "S" and the pixels therearound, the characteristic pattern of "S" is blurred and is unclearly displayed.

In the display apparatus according to the present embodiment, the display pattern indicating input luminances, which is equivalent to the original grayscale values (original signals), is converted into the grayscale values indicating brightness (bright signals) and the grayscale values indicating darkness (dark signals), and grayscale differences (luminance differences) are calculated between one picture element (one pixel unit) that is a determination target and other picture elements (other pixel units) adjacent to the picture element that is the determination target. The calculated grayscale differences each are compared to a corresponding one of the threshold values J, K, and L. When at least one of the grayscale differences exceed the corresponding threshold value J, K, or L, the original grayscale values are selected for the one picture element. When all of the grayscale differences do not exceed the corresponding threshold values J, K, and L, the grayscale values each indicating brightness or darkness are selected for the one picture element. In the above configuration, presentation of jagged appearance can be reduced and reduction in display quality can be suppressed even when an intermediate grayscale value is presented in a region where a luminance difference between adjacent picture elements is large. As a result, blurred display of a character, a figure, and the like indicated in the display pattern can be inhibited.

Alternatively, determination as to whether or not the grayscale values each exceed a corresponding one of the threshold values J, K, and L may be performed through calculation of grayscale differences between a picture element and at least one picture element adjacent to the picture element.

Furthermore, determination as to whether or not the grayscale values each exceed a corresponding one of the threshold values J, K, and L may be performed through calculation of grayscale differences between a picture element and a plurality of picture elements around, horizontally, vertically, or diagonally adjacent to the picture element.

In the embodiment described above, the grayscale setting section 50 is disposed posteriorly to the overdrive conversion section 40. Typically, the overdrive conversion section 40 is provided with frame memory for holding 1-frame display data, and executes irreversible compression on display data in order to reduce memory consumption.

As described above, the grayscale setting section 50 executes processing (grayscale conversion) by which the tables A and B are applied in a staggered manner to the pixels of the display data based on the allotment pattern. Therefore, if the grayscale setting section 50 is disposed anteriorly to the overdrive conversion section 40, compression is executed after grayscale conversion. This may involve an increase in compression error to invite reduction in display quality. In order to avoid a situation such as above, the grayscale setting section 50 is disposed posteriorly to the overdrive conversion section 40.

Variation Example

The following describes a variation example as result of partial alteration of the configuration of the above embodiment. In the variation example, the processing by the adjacent picture element determination section 51 is changed. The adjacent picture element determination section 51 determines whether or not to perform grayscale conversion on a pixel-by-pixel-basis rather than a picture element-by-picture element basis.

That is, the adjacent picture element determination section 51 determines whether or not the grayscale values of the R pixels satisfy $|X[-1,-1]-X[0,0]|\leq J$, $|X[0,-1]-X[0,0]|\leq J$, $|X[1,-1]-X[0,0]|\leq J$, $|X[-1,0]-X[0,0]|\leq J$, $|X[1,0]-X[0,0]|\leq J$, $|X[-1,1]-X[0,0]|\leq J$, $|X[0,1]-X[0,0]|\leq J$, and $|X[1,1]-X[0,0]|\leq J$.

The adjacent picture element determination section 51 determines to convert the grayscale value of the R pixel located at the target coordinates [0, 0] when all of the above relationships are satisfied, and determines not to convert the grayscale value of the R pixel located at the target coordinates [0, 0] when at least one of the above relationships is not satisfied. The same determination is applied to the grayscale values of the G pixel and the B pixel. In the above embodiment, a picture element constituted by a plurality of pixels is targeted and determination described in the embodiment is executed on each picture element as a whole. By contrast, determination as described above is executed on each pixel in the variation example.

Note that the adjacent picture element determination section 51 may calculate, similarly to in the embodiment, grayscale differences between each grayscale value of the R pixel, the G pixel, and the B pixel constituting the picture element located at the target coordinates [0, 0] and corresponding grayscale values of pixels constituting respective picture elements vertically, horizontally, or diagonally adjacent to the picture element located at the target coordinates [0, 0], rather than the aforementioned determination method. Whether or not to convert the grayscale value of each pixel constituting the picture element located at the target coordinates [0, 0] may be determined based on a result of calculation as described above.

FIG. 9 is a conceptual diagram illustrating variations of the allotment pattern. In the embodiment and the variation example described above, the allotment pattern of the tables A and the table B is not limited to the pattern illustrated in FIG. 8 (staggered pattern). For example, any one of allotment patterns in Variations 1 to 5 illustrated in FIG. 9 is applicable. In Variation 1, sets each composed of two horizontally successive As and sets each composed of two horizontally successive Bs are arranged in a staggered manner. In Variation 2, sets each composed of two vertically successive As and sets each composed of two vertically successive Bs are arranged in a staggered manner. In Variation 3, sets each composed of three horizontally successive As and sets each composed of three horizontally successive Bs are arranged in a staggered manner.

In Variation 4, sets each composed of a pair in which one of A and B and successive two of the other are arranged horizontally are arranged form a staggered pattern. That is, an ABB pair, an AAB pair, a BAA pair, and a BBA pair are sequentially arranged in a horizontal direction in each row, whereas the ABB pair and the BAA pair are adjacent to each other and the AAB pair and the BAA pair are adjacent to each other in a vertical direction. The sets of these pairs are arranged in a staggered manner as a whole.

In Variation 5, sets each composed of a pair of one of A and B and successive two of the other are arranged vertically to form a staggered pattern. That is, the ABB pairs and the BAA pairs, each of which is vertically arranged, are arranged alternately in the horizontal direction. The sets of these pairs are arranged in a staggered manner as a whole.

Any one of the allotment patterns is applied in consideration of for example display quality depending on arrangement of brightness and darkness and size (memory capacity) of a circuit constituting the grayscale conversion section 54 that converts R signals, G signals, and B signals to grayscale values indicating brightness or darkness.

Note that the number of pixels constituting a picture element is not limited to 3 and may be 1, 2, 4, or more. For example, the embodiment and the variation example are applicable to RGBY signals that are signals in which a yellow (Y) signal is added to R signal, G signal, and B signal. Also, the number of tables (tables A and B) for grayscale conversion is not limited to 2. For example, it is possible that a table A' for grayscale conversion into a brighter grayscale value than in the table A and a table B' for grayscale conversion into a darker grayscale value than in the table B are set in addition to the table A and B and Table A', A, C, B, or B' are applied to each pixel.

As described above, the display apparatus according to the present embodiment includes the display panel 1 in which a plurality of pixels are arranged in a matrix and a drive section 3 that drives the display panel 1 based on input signals. The display apparatus further includes a conversion section 54, a calculation section 51, a determination section 51, a selection section 53 and 56, and an input section 70. The conversion section 54 converts, for each of the pixels, an original signal indicating a luminance into either or both a bright signal and a dark signal. The bright signal indicates a luminance brighter than the luminance indicated by the original signal. The dark signal indicates a luminance darker than the luminance indicated by the original signal. The calculation section 51 calculates a luminance difference between an original signal for one pixel unit and an original signal for another pixel unit. The one pixel unit includes at least one pixel among the pixels. The other pixel unit is located adjacent to the one pixel unit, and includes at least one pixel other than the at least one pixel included in the one pixel unit among the pixels. The determination section 51 determines whether or not the luminance difference calculated by the calculation section 51 exceeds a threshold value. The selection section 53 and 56 selects the original signal for the one pixel unit when the determination section 51 determines that the luminance difference exceeds the threshold value, and selects the bright signal or the dark signal for the one pixel unit when the determination section 51 determines that the luminance difference does not exceed the threshold value. The input section 70 inputs to the drive section 3 the input signal based on a signal selected by the selection section 53 and 56.

According to the above configuration, a target luminance is presented by an effective luminance of a bright pixel and a dark pixel through conversion of the original signals into the bright signals or the dark signals in a region where a luminance difference between adjacent pixels (luminance difference between the target luminances) is small. By contrast, a luminance based on the original signal rather than the effective luminance of the bright pixel and the dark pixel is presented in a region where a luminance difference between adjacent pixels is large. Through the above, reduction in display quality such as jagged appearance can be suppressed while field of view angle characteristics can be improved. Thus, reduction in display quality can be suppressed in a situation in which the target luminance is presented by the effective luminance of the bight pixel and the dark pixel through conversion of the original signals into the bright signals or the dark signals.

In the display apparatus according to the present embodiment, it is possible that: the one pixel unit and the other pixel unit each include plural types of pixels; the calculation section 51 calculates the luminance differences between original signals for pixels of respective identical types in the one pixel unit and the other pixel unit; and the selection section 53 and 56 selects the original signal for the one pixel unit when the determination section 51 determines that at least one of the luminance differences calculated by the calculation section 51 exceeds the threshold value, and selects the bright signal or the dark signal for the one pixel unit when the determination section 51 determines that all of the luminance differences calculated by the calculation section 51 do not exceed the threshold value.

In the display apparatus according to the present embodiment, it is possible that: the calculation section 51 calculates luminance differences between the original signals for the one pixel unit and original signals for the respective other pixel units; the determination section 51 determines whether or not each of the luminance differences calculated by the calculation section 51 exceeds the threshold value; and the selection section 53 and 56 selects the original signal for the one pixel unit when the determination section 51 determines that at least one of the luminance differences exceeds the threshold value, and selects the bright signal or the dark signal for the one pixel unit when the determination section 51 determines that all of the luminance differences do not exceed the threshold value.

In the display apparatus according to the present embodiment, it is possible that the calculation section 51 calculates the luminance differences between the original signals for the one pixel unit and original signals for the plurality of other pixel units. The other pixel units is located around the one pixel unit or horizontally, vertically, or diagonally adjacent to the one pixel unit.

In the display apparatus according to the present embodiment, it is possible that: a pattern in which the bright signal or the dark signal is allotted for each of the pixels is set in advance; and the selection section selects the bright signal or the dark signal based on the pattern.

A display apparatus controlling method according to the present embodiment is a method for controlling a display apparatus that includes a display panel 1 in which a plurality of pixels are arranged in a matrix and a drive section 3 that drives the display panel 1 based on an input signal. The display apparatus controlling method includes: converting, for each of the pixels, an original signal indicating a luminance into either or both a bright signal and a dark signal, the bright signal indicating a luminance brighter than the luminance indicated by the original signal, the dark signal indicating a luminance darker than the luminance indicated by the original signal; calculating a luminance difference between an original signal for one pixel unit and an original signal for another pixel unit, the one pixel unit including at least one pixel among the pixels, the other pixel unit being located adjacent to the one pixel unit and including at least one pixel other than the at least one pixel included in the one pixel unit among the pixels; determining whether or not the calculated luminance difference exceeds a threshold value; selecting the original signal for the one pixel unit when it is determined that the luminance difference exceeds the threshold value, or selecting the bright signal or the dark signal for the one pixel unit when it is determined that the luminance difference does not exceed the threshold value; and inputting to the drive section 3 the input signal based on a selected signal. In the above configuration, the same advantages as in the display apparatus according to the present embodiment can be obtained.

Note that the presently-described embodiment is merely an example in all aspects and should not be construed to be limiting. Any technical features described in the embodiment can be combined with one another. The scope of the present embodiment is intended to encompass all variations and equivalents within the scope of claims.

For example, the grayscale setting section 50 in the above-described embodiment determines whether or not to convert the grayscale values of the target picture element through calculation of luminance differences between the target picture element and the adjacent picture elements (picture elements located adjacent to the target picture element) and determination as to whether or not the calculated luminance differences exceed the respective threshold values. However, the following is possible. That is, the grayscale setting section 50 may determine whether or not to convert the grayscale values of the target picture element through calculation of luminance differences between the target picture element and picture elements plural picture elements apart from the target picture element (for example, picture elements adjacent to the adjacent picture elements) in addition to the adjacent picture elements and determination as to whether or not the luminance differences do not exceed the respective threshold values.

Furthermore, the grayscale setting section 50 in the above-described embodiment converts the original signal into the bright signal and the dark signal for each pixel, and then selects the bright signal and the dark signal for each pixel when it is determined to convert the grayscale values. However, the following is possible. That is, the grayscale setting section 50 may convert an original signal for a pixel among the pixels of which grayscale value is determined to be converted into the bright signal or the dark signal.

REFERENCE SINGS LIST

1 display panel
2 gate drive section
2*a* gate signal line
3 source drive section
3*a* source signal line
10 control circuit
50 grayscale setting section
51 adjacent picture element determination section (calculation section, determination section)
52 memory
53 processing content determination section (selection section)
54 grayscale conversion section (conversion section)
55 LUT
56 grayscale selection section (selection section)
70 transmission section (input section)

The invention claimed is:

1. A display apparatus comprising: a display panel in which a plurality of pixels are arranged in a matrix; a controller configured to generate an input signal based on video data indicating a luminance that each of the pixels is to display; and a drive section that drives the display panel based on the input signal, wherein the controller includes:

a conversion section configured to convert, for all or some pixels of the pixels, an original signal indicating a luminance that each of the all or some pixels is to display into either or both a bright signal and a dark signal, the bright signal indicating a bright luminance brighter than the luminance indicated by the original signal, the dark signal indicating a dark luminance darker than the luminance indicated by the original signal, the bright luminance and the dark luminance being enabled to represent a luminance indicated by the original signal through both the bright luminance and the dark luminance being displayed;

a calculation section configured to calculate a luminance difference between an original signal for one pixel unit and an original signal for another pixel unit, the one pixel unit including at least one pixel among the pixels, the other pixel unit being located adjacent to the one pixel unit and including at least one pixel other than the at least one pixel included in the one pixel unit among the pixels;

a determination section configured to determine whether or not the luminance difference calculated by the calculation section exceeds a threshold value;

a selection section configured to perform selection to select the original signal for the one pixel unit when the determination section determines that the luminance difference exceeds the threshold value, and to select the bright signal or the dark signal for the one pixel unit when the determination section determines that the luminance difference does not exceed the threshold value; and an input section configured to input to the drive section the input signal based on a signal selected by the selection section, and through the controller performing the selection on each of a plurality of pixel units constituted by the pixels, the display apparatus causes a pixel included in a pixel unit of the pixel units for which it is determined that the luminance difference exceeds the threshold value to display the luminance indicated by the original signal, and causes a pixel included in a pixel unit of the pixel units for which it is determined that the luminance difference does not exceed the threshold value to display the bright luminance or the dark luminance, the plurality of pixel units including the one pixel unit and the other pixel unit.

2. The display apparatus according to claim 1, wherein the one pixel unit and the other pixel unit each include plural types of pixels, the calculation section calculates luminance differences between original signals for pixels of respective identical types in the one pixel unit and the other pixel unit, and the selection section selects the original signal for the one pixel unit when the determination section determines that at least one of the luminance differences calculated by the calculation section exceeds the threshold value, and selects the bright signal or the dark signal for the one pixel unit when the determination section determines that all of the luminance differences calculated by the calculation section do not exceed the threshold value.

3. The display apparatus according to claim 1, wherein the calculation section calculates luminance differences between the original signal for the one pixel unit and original signals for a plurality of the respective other pixel units, the determination section determines whether or not each of the luminance differences calculated by the calculation section exceeds the threshold value, and the selection section selects the original signal for the one pixel unit when the determination section determines that at least one of the luminance differences calculated by the calculation section exceeds the threshold value, and selects the bright signal or the dark signal for the one pixel unit when the determination section determines that all of the luminance differences calculated by the calculation section do not exceed the threshold value.

4. The display apparatus according to claim 3, wherein the calculation section calculates the luminance differences between the original signal for the one pixel unit and original signals for the plurality of other pixel units, the other pixel units being located around the one pixel unit or horizontally, vertically, or diagonally adjacent to the one pixel unit.

5. The display apparatus according to claim 1, wherein a pattern in which the bright signal or the dark signal is allotted for each of the pixels is set in advance, and the selection section selects the bright signal or the dark signal based on the pattern.

6. The display apparatus according to claim 5, wherein in the pattern, the dark signal is allotted to at least one of pixels adjacent to a pixel to which the bright signal is allotted.

7. The display apparatus according to claim 1, wherein for a pixel included in a pixel unit of the pixel units for which it is determined that the luminance difference does not exceed the threshold value, the controller performs conversion of the original signal to either or both the bright signal and the dark signal, and for a pixel included in a pixel unit of the pixel units for which it is determined that the luminance difference exceeds the threshold value, the controller does not perform the conversion.

8. A display apparatus controlling method for controlling a display apparatus that includes a display panel in which a plurality of pixels are arranged in a matrix, a controller that generates an input signal based on video data indicating a luminance that each of the pixels is to display, and a drive section that drives the display panel based on the input signal, the method comprising:

converting, for all or some pixels of the pixels, an original signal indicating a luminance that each of the all or some pixels is to display into either or both a bright signal and a dark signal, the bright signal indicating a bright luminance brighter than the luminance indicated by the original signal, the dark signal indicating a dark luminance darker than the luminance indicated by the original signal, the bright luminance and the dark luminance being enabled to represent a luminance indicated by the original signal through both the bright luminance and the dark luminance being displayed;

calculating a luminance difference between an original signal for one pixel unit and an original signal for another pixel unit, the one pixel unit including at least one pixel among the pixels, the other pixel unit being located adjacent to the one pixel unit and including at least one pixel other than the at least one pixel included in the one pixel unit among the pixels;

determining whether or not the calculated luminance difference exceeds a threshold value;

performing selection of the original signal for the one pixel unit when it is determined that the luminance difference exceeds the threshold value, or performing selection of the bright signal or the dark signal for the one pixel unit when it is determined that the luminance difference does not exceed the threshold value; and inputting to the drive section the input signal based on a selected signal, wherein through execution of the selection on each of a plurality of pixel units constituted by the pixels, a pixel included in a pixel unit of the pixel units for which it is determined that the luminance difference exceeds the threshold value is caused to display the luminance indicated by the original signal, and a pixel included in a pixel unit of the pixel units for which it is determined that the luminance difference does not exceed the threshold value is caused to display the bright luminance or the dark luminance, the plurality of pixel units including the one pixel unit and the other pixel unit.

* * * * *